US006754063B2

(12) United States Patent
Aleardi

(10) Patent No.: US 6,754,063 B2
(45) Date of Patent: Jun. 22, 2004

(54) ELECTRIC GAS LIGHTER

(75) Inventor: Massimo Aleardi, Cassano Magnago (IT)

(73) Assignee: ITW Industrial Components S.R.L., Milan (IT)

( * ) Notice: Subject to any disclaimer, the term of this patent is extended or adjusted under 35 U.S.C. 154(b) by 229 days.

(21) Appl. No.: 10/024,484

(22) Filed: Dec. 21, 2001

(65) Prior Publication Data

US 2002/0132204 A1 Sep. 19, 2002

(30) Foreign Application Priority Data

Dec. 22, 2000 (IT) ..... MI2000A2815

(51) Int. Cl.[7] ..... H05B 37/02
(52) U.S. Cl. ..... 361/253; 361/247
(58) Field of Search ..... 361/247, 253; 431/261, 258, 281

(56) References Cited

U.S. PATENT DOCUMENTS 4,413,611 A * 11/1983 Berlik et al. ..... 126/39 E
4,626,193 A * 12/1986 Gann ..... 431/71

* cited by examiner

*Primary Examiner*—Stephen W. Jackson
*Assistant Examiner*—Boris Benenson
(74) *Attorney, Agent, or Firm*—Lowe Hauptman Gilman & Berner LLP

(57) ABSTRACT

An electric gas lighter having a lighting circuit for generating sparks at at least one burner. The lighting circuit is connected to a power line supplying a supply voltage, and has an enabling terminal for enabling spark generation when connected to a reference-potential line, or disabling spark generation when floating. The gas lighter also has hand-operated switches having at least a first terminal connected to the enabling terminal of the lighting circuit by a connecting line, and at least a second terminal connected to the reference-potential line.

18 Claims, 1 Drawing Sheet

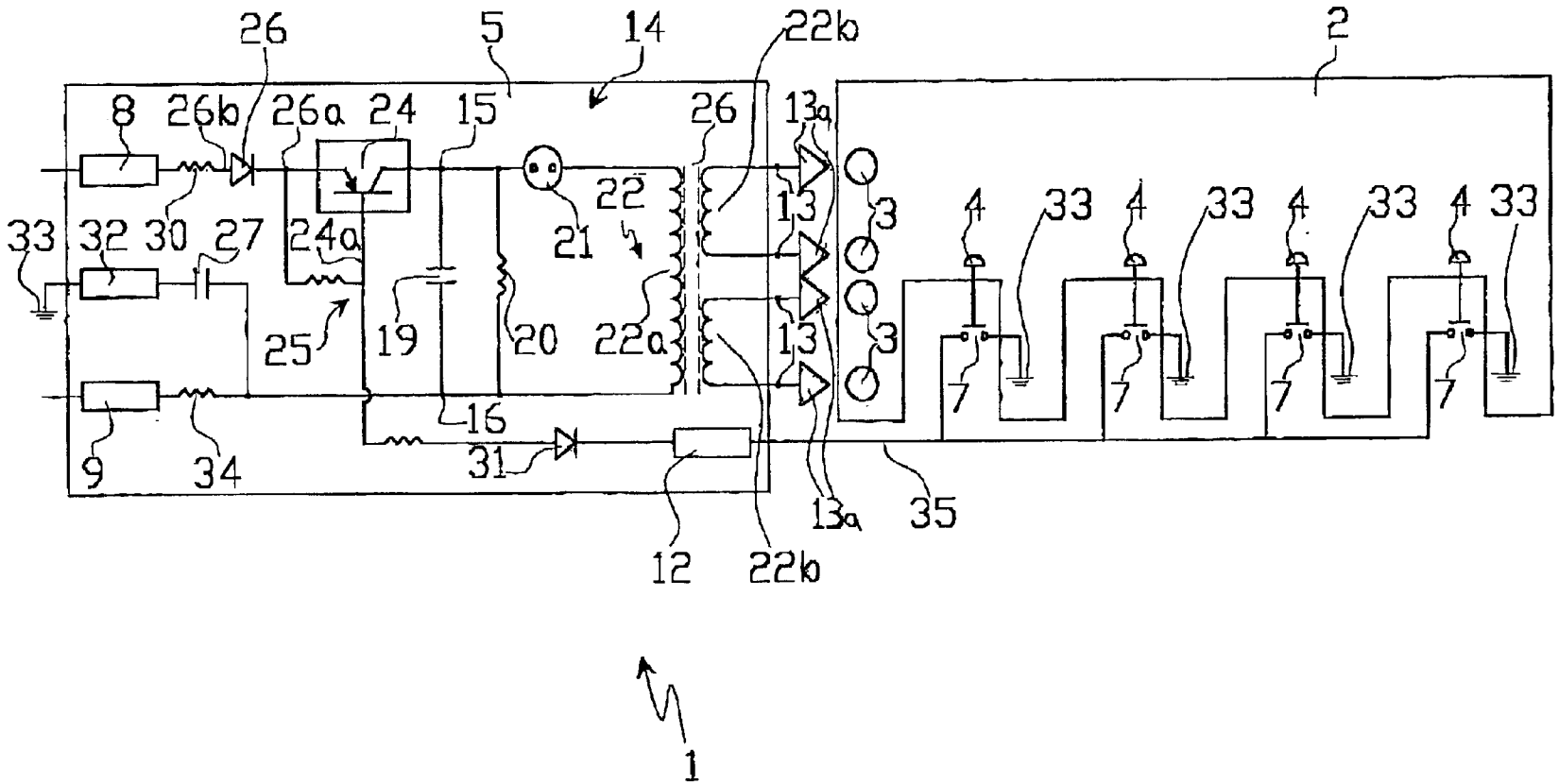
1
2
3
4
5
7
8
9
12
13
13a
14
15
16
19
20
21
22
22a
22b
24
24a
25
26
26a
26b
27
30
31
32
33
34
35

ELECTRIC GAS LIGHTER

The present invention relates to an electric gas lighter which may be used, for example, on the gas range of a gas cooker.

BACKGROUND OF THE INVENTION

Electric gas lighters for producing sparks to light burners on the gas range of a gas cooker are known, and normally comprise a lighting circuit fitted underneath the gas range and for generating the sparks; and one or more hand-operated switches for activating the lighting circuit.

More specifically, the lighting circuit is connected to a power line having a neutral line and a phase line supplying alternating voltage, and comprises two enabling terminals, one of which is connected to the neutral line.

The normally-open hand-operated switches are connected in parallel between the enabling terminals of the lighting circuit, and, being hand-operated by the user, are formed on the flame-regulating panel of the gas range. Push-button switches are normally used, and are preferably activated by the flame-regulating knobs which, when pressed, close a contact to allow gas flow through the respective burners.

Known gas lighters have several drawbacks. In particular, since the hand-operated switches are located some distance from the lighting circuit, each must be provided with two wires for electric connection to the enabling terminals of the lighting circuit. Consequently, the lighting circuit must be provided with two terminals for connection to the respective wires and is therefore unduly bulky and complicated to produce. Moreover, the presence of two wires between the lighting circuit and hand-operated switches makes it difficult to assemble the lighters to the respective burners.

SUMMARY OF THE INVENTION

It is an object of the present invention to provide a gas lighter designed to eliminate the aforementioned drawbacks, and which, in particular, is compact, is cheap and easy to produce, and can be fitted easily to a respective gas range.

According to the present invention, there is provided an electric gas lighter comprising a lighting circuit for generating sparks at at least one burner; said lighting circuit being connected to a power line supplying a supply voltage, and having an enabling terminal for enabling spark generation when connected to a reference-potential line, or disabling spark generation when floating; characterized by comprising hand-operated switching means having at least one first terminal connected to said enabling terminal of said lighting circuit by a connecting line; and at least one second terminal connected to said reference-potential line.

The hand-operated switches are connected to the reference-potential (ground) line by simply connecting the second terminals of the switches to the gas range, so that connection to the neutral line of the power line is no longer required, and only one wire is required from the lighting circuit to the hand-operated switches. By only requiring one enabling terminal to connect the control terminal of the controlled switch to the hand-operated switches, the lighting circuit is therefore more compact and easier to produce; and, there being only one wire between the lighting circuit and the hand-operated switches, the gas lighter is easier to fit to the gas range.

BRIEF DESCRIPTION OF THE DRAWING

A non-limiting embodiment of the invention will be described by way of example with reference to the accompanying drawing, which shows a circuit diagram of a gas lighter in accordance with the present invention.

DETAILED DESCRIPTION OF THE INVENTION

As shown in the accompanying drawing, an electric gas lighter, indicated as a whole by 1, is connected to a gas range 2 of a gas cooker. More specifically, gas lighter 1 is housed at least partly in a casing (not shown for the sake of simplicity) fitted in known manner to gas range 2.

Gas range 2 is made of conducting material, preferably metal, and comprises a number of burners 3 connected to respective regulating knobs 4 for regulating gas flow through burners 3.

Gas lighter 1 comprises a lighting circuit 5 for generating sparks at burners 3; and a number of hand-operated switches 7, each for and located at a respective regulating knob 4.

Lighting circuit 5 has a first and second input terminal 8, 9 connected respectively to a phase line and a neutral line of a power line supplying an alternating supply voltage $V_S$; an enabling terminal 12; and output terminals 13 connected to respective electrodes 13*a* located close to burners 3 and insulated electrically from gas range 2 to generate sparks and ignite the gas.

Lighting circuit 5 comprises a discharge-generating circuit 14, in turn comprising a storage capacitor 19 and a discharge resistor 20 connected parallel, downstream from an electronically controlled switch 24, between a first and second node 15, 16; a discharger 21; and a transformer 22. Discharger 21—preferably a gas discharge tube (GDT)—has one terminal connected to first node 15, and is also connected in series to a primary winding 22*a* of transformer 22, in turn connected to second node 16 Transformer 22 also comprises at least one secondary winding 22*b* (two in the embodiment described) connected between two respective output terminals 13 of lighting circuit 5.

Lighting circuit 5 comprises electronically controlled switch 24; an activating divider 25; a rectifier diode 26; and a filtering capacitor 27. More specifically, electronically controlled switch 24 has a control terminal 24*a*; a first terminal connected to first node 15; and a second terminal connected to the cathode 26*a* of rectifier diode 26, the anode 26*b* of which is connected to first input terminal 8 of lighting circuit 5 via a first input resistor 30. Electronically controlled switch 24 is preferably defined by a PNP bipolar transistor having the emitter terminal connected to cathode 26*a* of rectifier diode 26, the collector terminal connected to first node 15, and the base terminal forming control terminal 24*a*.

Activating divider 25 is located between the second terminal of electronically controlled switch 24 and enabling terminal 12, to which it is connected via a shutdown diode 31, and has an intermediate node connected to control terminal 24*a* of electronically controlled switch 24.

Filtering capacitor 27 has a first terminal connected to second node 16, in turn connected to the second input terminal via a second resistor 34. A second terminal of filtering capacitor 27 is connected to a ground terminal 32 connected to a constant-potential ground line 33.

Hand-operated switches 7 have respective first terminals connected to enabling terminal 12 of lighting circuit 5 by a wire 35, and respective second terminals connected to ground line 33, so that hand-operated switches 7 are connected in parallel. Hand-operated switches 7 are normally-open types and are closed to connect enabling terminal 12 to ground line 33 when respective regulating knobs 4 are pressed.

Both ground terminal 32 and the second terminals of hand-operated switches 7 are connected to ground line 33 by direct connection to gas range 2, which is made of conducting material, so that lighting circuit 5 and hand-operated switches 7 are connected to one another exclusively by wire 35.

Gas Lighter 1 Operates as Follows.

When hand-operated switches 7 are all open, enabling terminal 12 and control terminal 24*a* are at the potential of cathode 26*a* of rectifier diode 26, and electronically controlled switch 24 is open (the transistor defining electronically controlled switch 24, in fact, is disabled), so that gas lighter 1 draws no current and, since the primary winding 22*a* of transformer 22 is not energized, no spark is generated.

When one of regulating knobs 4 is pressed, the corresponding hand-operated switch 7 is closed, enabling terminal 12 is connected to ground line 33, and the control terminal 24*a* of electronically controlled switch 24 is also connected to ground line 33 by a branch of activating divider 25 and shutdown diode 31, thus enabling spark generation. More specifically, during positive half-waves of supply voltage $V_S$, electronically controlled switch 24 is closed (the transistor defining electronically controlled switch 24 conducts), so that storage capacitor 19 is charged to a predetermined threshold voltage. When the threshold voltage is exceeded, storage capacitor 19 discharges to primary winding 22*a* of transformer 22 via discharger 21, so that the secondary winding 22*b* is also energized to generate sparks between electrodes 13*a* and respective burners 3.

Clearly, changes may be made to the gas lighter as described herein without, however, departing from the scope of the present invention. In particular, hand-operated switches 7 described may be replaced with a single hand-operated push-button switch operated separately and independently of regulating knobs 4 and connected between ground line 33 and enabling terminal 12 by wire 35.

Lighting circuit 5 may also be formed otherwise than as described. For example, electronically controlled switch 24 may be defined by a silicon controlled rectifier (SCR) or by a different type of electronic switch; and lighting circuit 5 may be modified in obvious manner for negative half-wave operation.

What is claimed is:

1. An electric gas lighter for a gas range, said lighter comprising:

a lighting circuit for generating sparks at at least one burner of the gas range, said lighting circuit being connectable source including a live line, a neutral line and ground, to a power and said lighting circuit having an enabling terminal for enabling or disabling spark generation when said enabling terminal is connected to or disconnected from ground respectively; and at least one hand-operated switch for said at least one burner, said switch having at least one first terminal that is connected to said enabling terminal of said lighting circuit by a connecting line, and at least one second terminal that is grounded.

2. A gas lighter as claimed in claim 1, comprising a number of said hand-operated switches connected in parallel between said connecting line and said ground;

each of said hand-operated switches corresponding to one among a plurality of said burners, and being operated by means of respective regulating knobs.

3. A gas lighter as claimed in claim 1, wherein said lighting circuit comprises:

at least one first input terminal connectable to said power source;

at least one output terminal for generating sparks at said at least one burner;

a transformer having a primary winding connected between a first node and a second node, and at least one secondary winding connected to said at least one output terminal; and an electronically controlled switch interposed between said first input terminal and said primary winding, and having a control terminal connected to said enabling terminal.

4. A gas lighter as claimed in claim 3, wherein said electronically controlled switch comprises a silicon controlled rectifier.

5. The gas lighter of claim 1, wherein said ground includes a conducting part of the gas range, and said at least one second terminal of said hand-operated switch is electrically connected to said conducting part of the gas range.

6. An electric gas lighter, comprising a lighting circuit for generating sparks at at least one burner said lighting circuit being connectable to a power line supplying a supply voltage and having an enabling terminal for enabling or disabling spark generation when connected to or disconnected from a reference-potential line, respectively; and hand-operated switching means having at least one first terminal connected to said enabling terminal of said lighting circuit by a single connecting line, and at least one second terminal connected to said reference-potential line;

wherein said lighting circuit comprises:

at least one first input terminal connectable to said power line;

at least one output terminal for generating sparks at said at least one burner;

a transformer having a primary winding connected between a first node and a second node, and at least one secondary winding connected to said at least one output terminal; and electronically controlled switching means interposed between said first input terminal and said primary winding;

wherein said electronically controlled switching means comprise a transistor having a first conducting terminal connected to said first node, a second conducting terminal connected to said first input terminal, and a control terminal connected to said enabling terminal.

7. A gas lighter as claimed in claim 6, wherein said lighting circuit also comprises:

a second input terminal connectable to a neutral line;

a rectifier diode connected between said first input terminal and said first conducting terminal of said transistor;

a capacitor connected between said first node and said second node, downstream from said electronically controlled switching means;

discharging means connected in series to said primary winding of said transformer; and voltage-dividing means connected between said second conducting terminal of said transistor and said enabling terminal, and having an intermediate node connected to said control terminal.

8. An electric gas lighter for a gas range, said lighter comprising:

a lighting circuit being connectable to a power source for generating sparks, including a hot line, a neutral line and a ground line, at at least one burner of the gas range, said lighting circuit having an enabling node and being configured so that a capability of said lighting circuit to generate sparks depends on presence or absence of a reference potential on said node;

at least one hand-operated switch for said at at least one burner, said switch having a first contact and a second contact which is connected to said reference potential; and a connecting element connecting said switch and said lighting circuit, said connecting element consisting essentially of a single insulated wire that connects the first contact of said switch with said node of said lighting circuit, whereby switching operations of said switch cause said reference potential to be applied to or removed from said node.

9. The gas lighter of claim 8, wherein the gas range includes a conducting part, and said second contact of said switch is electrically connected to said conducting part of the gas range.

10. The gas lighter of claim 8, wherein said reference potential is the ground potential.

11. The gas lighter of claim 8, wherein a voltage of said power source is provided between the hot line and the neutral line, to which the lighting circuit is connected; and said voltage is not present between said first and second contacts of said switch regardless of whether said switch is open or closed.

12. The gas lighter of claim 8, wherein a voltage of said power source is provided between the hot line and the neutral line, to which the lighting circuit is connected; and the first contact of said switch is connected to one of said hot and neutral lines, via said single insulated wire, said node and a voltage divider.

13. The gas lighter of claim 12, wherein said lighting circuit comprises:

a spark generating circuit for generating sparks at said at least one burner; and an electronically controlled switch coupled between said hot and neutral lines of said power source and said spark generating circuit for selectively supplying the voltage of said power source to said spark generating circuit depending on presence or absence of said reference potential on said node;

wherein said electronically controlled switch has a control terminal for turning on or off said electronically controlled switch, said control terminal being connected to a middle point of said voltage divider.

14. The gas lighter of claim 13, wherein said spark generating circuit comprises:

at least one output terminal for generating sparks at said at least one burner; and a transformer having a primary winding connected between a first node and a second node, and at least one secondary winding connected to said at least one output terminal;

wherein said electronically controlled switch comprises a transistor having a first conducting terminal connected to said first node, a second conducting terminal connectable to one of said hot and neutral lines of said power source, and said control terminal.

15. The gas lighter of claim 13, wherein said electronically controlled switch comprises a silicon controlled rectifier.

16. The gas lighter of claim 14, wherein the second node is connected to the other of said hot and neutral lines of said power source, and said spark generating circuit also comprises:

a capacitor connected between said first node and said second node, downstream from said electronically controlled switch; and a discharger for said capacitor, said discharger being connected in series to said primary winding of said transformer.

17. An electric gas lighter for a gas range, said lighter comprising:

spark generating circuit means for generating sparks at least one burner of the gas range;

first, electronically controlled switching means coupled between a power source, including a hot line, a neutral line and a ground line, and said spark generating circuit means for controllably supplying a voltage of said power source to said spark generating circuit means depending on presence or absence of a ground potential on a control node of said first switching means; and second switching means for controllably grounding the control node to turn on or off said first switching means.

18. The gas lighter of claim 17, further comprising connecting means for connecting said first and second switches, said connecting means consisting essentially of a single insulated wire.

* * * * *